United States Patent [19]

Sugiura et al.

[11] 4,112,903

[45] Sep. 12, 1978

[54] IGNITION SYSTEM FOR AN INTERNAL COMBUSTION ENGINE

[75] Inventors: Noboru Sugiura, Nakamachi; Seiji Suda, Mito, both of Japan

[73] Assignee: Hitachi, Ltd., Japan

[21] Appl. No.: 702,896

[22] Filed: Jul. 6, 1976

[30] Foreign Application Priority Data

Jul. 4, 1975 [JP] Japan ..... 50-81794

[51] Int. Cl.[2] ..... F02P 3/02

[52] U.S. Cl. ..... 123/148 E

[58] Field of Search ..... 123/148 E, 117 R; 307/310

[56] References Cited

U.S. PATENT DOCUMENTS

| | | | |
|---|---|---|---|
| 3,908,622 | 9/1975 | Long | 123/148 E |
| 3,933,141 | 1/1976 | Gunderson | 123/148 E |

*Primary Examiner*—Samuel Feinberg

*Attorney, Agent, or Firm*—Craig & Antonelli

[57] ABSTRACT

A detecting means for detecting an alternating signal produced by a pickup coil in timed relationship with engine rotation is provided by a circuit including in combination a P-N-P transistor and an N-P-N transistor. The temperature effects of these transistors, each of which has a characteristic which shifts with respect to the operating level thereof, compensate each other and the current through the ignition coil is thereby controlled in response to the output of the detecting means independent of the effects of temperature.

8 Claims, 2 Drawing Figures

IGNITION SYSTEM FOR AN INTERNAL COMBUSTION ENGINE

BACKGROUND OF THE INVENTION

This invention relates to an ignition system for an internal combustion engine, and more particularly, to a temperature compensating circuit for the ignition system of an internal combustion engine.

In a conventional ignition system for an internal combustion engine in which an alternating signal produced in timed relationship with engine rotation is produced in a pickup coil and applied to a detecting means which controls a switching means to produce or interrupt current through an ignition coil, an N-P-N transistor or a P-N-P transistor are used as the detecting means for the alternating signal and the detecting level (threshold level) for the alternating signal is determined by the voltage drop of the base to emitter path of the transistor. Since this voltage drop varies with changes in ambient temperature, the detecting condition of the transistor is effected by the temperature. A diode has been used for compensating the detecting condition of the transistor for variations in temperature; however, the diode consumes considerable energy of the alternating signal in producing a voltage drop which varies with the temperature in such a way as to shift the detecting level to compensate for the temperature effects of the detecting transistor. During low speed engine rotation, the energy of this alternating signal is very small, and, therefore, it is impossible to apply an alternating signal of sufficient energy to the detecting means during such operation due to the power consumption of this diode.

It is an object of this invention to provide an improved ignition system for an internal combustion engine.

It is a further object of this invention to provide an improved ignition system for an internal combustion engine in which a diode for compensating temperature effects of an alternating signal detecting means is not required.

It is another object of this invention to provide an ignition system having improved low speed operating characteristics.

In accordance with this invention, a detecting means for an alternating signal includes a circuit in which a P-N-P transistor and an N-P-N transistor are associated with each other so that the temperature effects of the base to emitter paths of these transistors compensate each other. Therefore, the detecting means operates independent of temperature in response to the alternating input signals with the result that current through the ignition coil is controlled more perfectly.

These and objects, features, and advantages of the present invention will be more apparent from the following detailed description thereof with reference to the accompanying drawings, which illustrate a preferred embodiment of this invention, and wherein.

DETAILED DESCRIPTION

Figure 1:
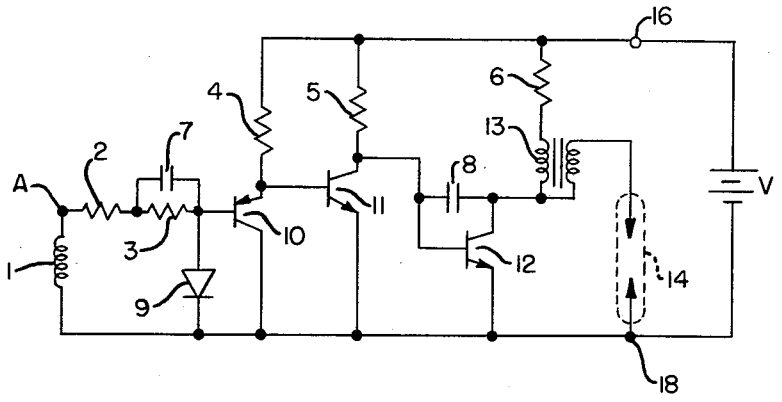
FIG. 1 is a schematic circuit diagram of an ignition system for an internal combustion engine according to this invention.

Referring to FIG. 1, means for producing an alternating signal in timed relationship with engine rotation comprises a pickup coil 1 associated with an alternating signal generator (not shown), resistors 2 and 3 and a capacitor 7. A circuit comprising a P-N-P transistor 10, an N-P-N transistor 11, resistors 4 and 5, and a diode 9 is operated as a detecting means for producing pulses in response to the output of the alternating signal generator. A switching means, which comprises a capacitor 8 and a power transistor 12, operates to establish a current charging circuit which may be traced from the positive terminal 16 of a d.c. power source V through a resistor 6, primary winding of the ignition coil 13 and the collector to emitter path of transistor 12 to the ground terminal 18 of the d.c. power source V. The switching means serves to interrupt such charging circuit for producing a spark voltage in the secondary winding of the ignition coil to provide a spark discharge across the contacts of a plug 14 in the known manner.

Figure 2:
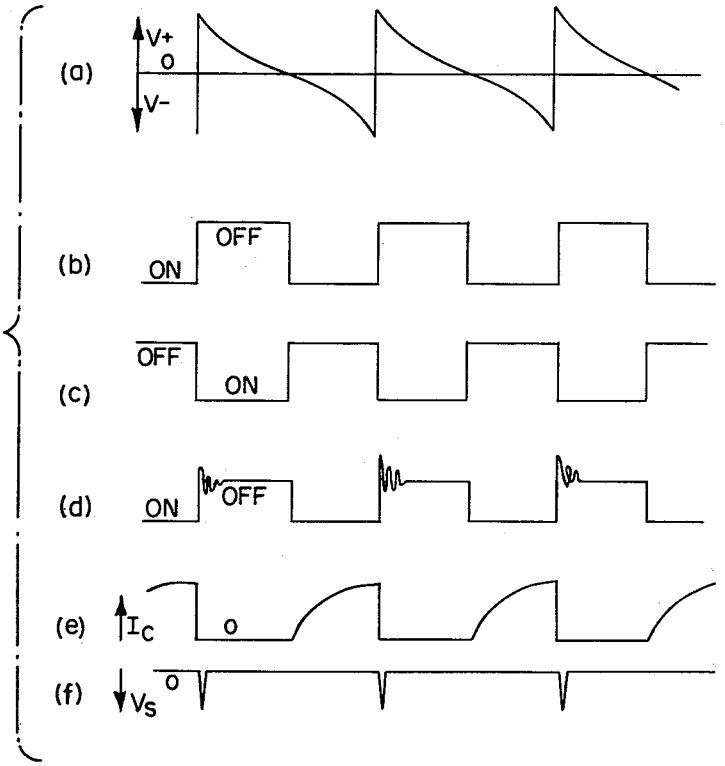
FIG. 2 is a waveform explaining the operation of the ignition system of FIG. 1.

The alternating signal illustrated in FIG. 2(*a*) is produced at a terminal A at one end of the pickup coil 1 in timed relationship with engine rotation and is applied to the base of the P-N-P transistor 10 through the series connected resistors 2 and 3. The negative half-cycle of the alternating signal causes the P-N-P transistor 10 to conduct thereby placing the base of N-P-N transistor 11 at ground potential to prevent conduction thereof. The power transistor 12 is therefore permitted to conduct, as a result of the base-emitter current flowing through resistor 5, thereby producing current in the ignition coil 13 from the positive terminal 16 of the d.c. power source V through the resistor 6, the primary winding of the ignition coil 13 and the power transistor 12 to the ground terminal 18 of the d.c. power source V.

FIG. 2(*b*) shows the voltage waveform of the emitter voltage of the transistor 10 and FIG. 2(*c*) shows the collector voltage waveform of the collector voltage of transistor 11. FIG. 2(*d*) shows the collector voltage waveform of the collector voltage of power transistor 12, and FIG. 2(*e*) shows the current waveform which flows through the primary winding of the ignition coil 13. FIG. 2(*f*) shows the high voltage waveform produced in the secondary winding of the ignition coil 13 and applied to the spark plug 14.

When the alternating signal as shown in FIG. 2(*a*) produced in pickup coil 1 changes to a positive value, the P-N-P transistor 10 turns off, the N-P-N transistor 11 turns on, and the power transistor 12 interrupts the charging circuit for the ignition coil 13. The high spark voltage is produced in the secondary winding of the ignition coil 13 and applied to the spark plug 14.

A capacitor 7 is provided to compensate for the lagging of the current due to the inductance of the pickup coil 1. A diode 9 is also provided between the base and the collector of the transistor 10 to protect the transistor 10 from inverse high voltage noises. A capacitor 8 is provided to remove any surge voltage which may be produced by the turn-off operation of the power transistor 12.

The operations of the transistors 10 and 11 are as follows. The emitter potential of the transistor 10 is determined by the voltage across the base and emitter of the transistor 11. When the base potential of transistor 10 is lowered by the alternating signal to a value less than the forward voltage drop of the emitter to base path of the transistor 10, base current is established from the positive terminal 16 of d.c. power source V through the resistor 4 and the emitter to base path of the transistor 10 to the ground terminal 18. The forward drop of the emitter to base path of the transistor 10 is changed in response to variations in ambient temperature. Thus, if the emitter potential of the transistor 10 is fixed to a constant value, the operating level or detecting level for the alternating signal from the pickup coil 1 will be shifted by variations in the temperature. However, in accordance with the present invention, the emitter potential of the transistor 10 is determined by the forward voltage drop of the base to emitter path of the transistor 11. Since the forward voltage drop of the base to emitter path is changed by variations in temperature and the temperature resistance characteristics of the forward voltage drop of the transistor 11 is nearly equal to the forward drop of the emitter to base path of the transistor 10 when silicon transitors are used as transistors 10 and 11, the transistors will compensate one another and the operating level of the transistor 10 for the alternating signal produced by the pickup coil 1 will be independent of temperature variations.

In accordance with the present invention, it is possible to detect the alternating signal independent of temperature variations so that current through the ignition coil can be properly controlled for all conditions of temperature.

In the present invention, the detecting means for the alternating signal comprises a combination circuit formed by the P-N-P transistor 10 and the N-P-N transistor 11 and these transistors each have amplifying ability. Therefore, when the alternating signal produced in the pickup coil is very small, the detecting means of the present invention is able to detect the small input signal and respond thereto exactly.

While we have shown and described an embodiment in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

What is claimed is:

1. An ignition system for an internal combustion engine comprising an ignition coil having a primary winding, switching means connected to said primary winding for controlling the current flow therethrough, generating means for producing alternating signals in timed relationship with engine rotation, and control means responsive to said alternating signals for controlling the operation of said switching means, said control means including a first transistor connected to said generating means and operated in accordance with the alternating signals therefrom, and a second transistor having substantially identical temperature characteristics as said first transistor and being of opposite conductivity type connected between said first transistor and said switching means such that the conduction of said first transistor biases said second transistor into non-conduction, and such that the temperature effects of the base to emitter paths of these transistors compensate each other.

2. An ignition system as defined in claim 1 wherein said first and second transistors are silicon transistors.

3. An ignition system as defined in claim 1 wherein said first transistor is a P-N-P transistor having its base connected to said generating means and said second transistor is an N-P-N transistor having its base connected to the emitter of said first transistor so that the emitter potential of said first transistor is controlled by the base-emitter impedance of said second transistor.

4. An ignition system for an internal combustion engine comprising an ignition coil having a primary winding, first means for providing a direct current, voltage switching means connected in series with said primary winding across said first means for controlling the current flow through said primary winding, generating means for producing alternating signals in timed relationship with engine rotation, and control means responsive to said alternating signals for controlling the operation of said switching means, said control means including a first transistor having a base, an emitter and a collector, the base of said first transistor being connected to said generating means, and the emitter and collector thereof being connected across said first means, and a second transistor of opposite conductivity type as said first transistor having a base connected to the emitter of said first transistor, a collector and an emitter connected across said first means so that the emitter potential of said first transistor is controlled by the base-emitter impedance of said second transistor, said first and second transitors having substantially identical temperature characteristics.

5. An ignition system as defined in claim 4 wherein said first and second transistors are silicon transistors.

6. An ignition system as defined in claim 4 wherein said first transistor is a P-N-P transistor and said second transistor is an N-P-N transistor.

7. An ignition system for an internal combustion engine comprising a direct current source having two terminals, a P-N-P transistor, a first resistor connected between said direct current source and said P-N-P transistor through which a positive potential is applied to the emitter of the P-N-P transistor, a pickup coil for producing an alternating signal in timed relationship with engine rotation, first connecting means for applying the alternating signal to the base of the P-N-P transistor, second connecting means for connecting the collector of the P-N-P transistor to the negative terminal of the direct current source, an N-P-N transistor, the base of said N-P-N transistor being connected to the emitter of the P-N-P transistor and the emitter of said N-P-N transistor being connected to the negative terminal of the direct current source, third connecting means for applying a positive potential from the positive terminal of the direct current source to the collector of the N-P-N transistor, an ignition coil having a primary winding, switching means for controlling the current through said primary winding, fourth connecting means for connecting the primary winding of the ignition coil and the switching means in series across the terminals of the direct current source, and fifth connecting means for applying the output of the N-P-N transistor to said switching means for controlling the operating condition thereof in response to the output of the N-P-N transistor.

8. An ignition system for an internal combustion engine comprising:

an ignition coil having a primary winding, switching means connected to said primary winding for controlling the current flow therethrough, generating means for producing alternating signals in timed relationship with engine rotation, a P-N-P transistor having a base, an emitter and a collector, first connecting means for applying outputs of the generating means between the base and the collector of the P-N-P transistor, an N-P-N transistor having a base, an emitter and a collector, second connecting means for applying the emitter voltage of the P-N-P transistor between the base and emitter of the N-P-N transistor, and third connecting means for applying the output of the N-P-N transistor to the switching means.

* * * * *